US005366006A

United States Patent [19]

Lu et al.

[11] Patent Number: 5,366,006

[45] Date of Patent: Nov. 22, 1994

[54] TAB JOINT BETWEEN COOLANT TUBE AND HEADER

[75] Inventors: James W. B. Lu, West Bloomfield; Norman F. Costello, Farmington Hills, both of Mich.; Kevin E. Stay, Grapevine, Tex.; Herbert Damsohn, Aichwald, Germany

[73] Assignees: McCord Heat Transfer Corporation, Walled Lake, Mich.; Behr GmbH & Co., Stuttgart, Germany

[21] Appl. No.: 24,414

[22] Filed: Mar. 1, 1993

[51] Int. Cl.[5] ..... F28F 9/02

[52] U.S. Cl. ..... 165/173; 285/382

[58] Field of Search ..... 165/173, 178; 285/202, 285/203, 287, 382

[56] References Cited

U.S. PATENT DOCUMENTS

| | | | |
|---|---|---|---|
| 1,053,743 | 2/1913 | Paiste | 285/203 X |
| 1,995,616 | 3/1935 | Kamack | 285/287 |
| 2,614,868 | 10/1952 | Robinson | 285/203 |
| 3,506,286 | 4/1970 | Defauw | 285/203 |
| 3,972,371 | 8/1976 | Plegat | 165/178 |
| 4,195,943 | 4/1980 | Williams | 285/202 X |
| 4,334,703 | 6/1982 | Arthur et al. | 285/222 |
| 4,467,511 | 8/1984 | Collgon | 29/157.3 C |
| 4,529,034 | 7/1985 | Saperstein | 285/287 X |
| 4,580,324 | 4/1986 | Laska | 29/157.4 |
| 5,036,913 | 8/1991 | Murphy et al. | 165/173 |

*Primary Examiner*—Stephen M. Hepperle

*Attorney, Agent, or Firm*—Reising, Ethington, Barnard, Perry & Milton

[57] ABSTRACT

A heat exchanger including a joint (26) for joining the end (28) of a coolant tube (12) to a header (14). The header (14) includes an aperture (22) extending therethrough with a ferrule (24) circumferentially disposed thereabout. At least one tab (32) extends upward from the ferrule (24) for providing attachment to the end (28) of the coolant tube (12).

11 Claims, 3 Drawing Sheets

TAB JOINT BETWEEN COOLANT TUBE AND HEADER

BACKGROUND OF THE INVENTION

1. Technical Field

The present invention generally relates to heat exchangers and more specifically to a joint for joining an end of a coolant tube to a header.

2. Background Art

In an effort to extend the duration and durability of heat exchangers, much development has been focused upon improving the joint formed between the ends of coolant tubes and the header plate. For example, early on, those skilled in the art began forming ferrules or collars circumferentially about the apertures extending through the header in an effort to provide additional support between the header and the end of the tube. Further developments included mechanical locking measures such as providing staked portions between the end of the tube and ferrule, as shown in U.S. Pat. No. 4,334,703 to Arthur et al. Yet another development is shown in U.S. Pat. No. 5,036,913 wherein portions of the ferrule are welded to portions of the end of the coolant tube.

A major disadvantage to prior art tube-header joints is that the strength of the ferrule and the end of the tube are compromised in the process of securing the two together. For example, the temperature created by welding a portion of the ferrule and tube end weakens the metallurgical strength of both the ferrule and tube end at locations adjacent the weld area, thus resulting in failure over time.

SUMMARY OF THE INVENTION AND ADVANTAGES

The present invention is a heat exchanger including a header having at least one aperture extending therethrough wherein the aperture includes a ferrule disposed circumferentially thereabout. The heat exchanger further includes at least one coolant tube. A joint is formed by the end of the coolant tube disposed within the aperture of the header and in interfacial contact with the periphery of the aperture and ferrule. The heat exchanger is characterized by the joint including at least one tab extending from the ferrule for attaching the end of the coolant tube to the header.

An advantage of providing a tab extending from the ferrule for attachment to the end of the tube is that the point of attachment between the tube and header is spaced from the ferrule, thereby avoiding a compromise in the strength of the ferrule or tube end at the critical interface therebetween.

The present invention further includes a method for making the subject joint between the end of the coolant tube and the header. The method comprising the steps of: forming a cup-shaped depression into the header wherein the depression includes side walls and a extreme end, forming at least one tab in the extreme end of the depression, deforming the tab outward to form an aperture with the side walls defining a ferrule circumferentially disposed about the aperture, disposing an end of the coolant tube within the aperture, and fastening the tab to the end of the coolant tube in order to secure the coolant tube to the header.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
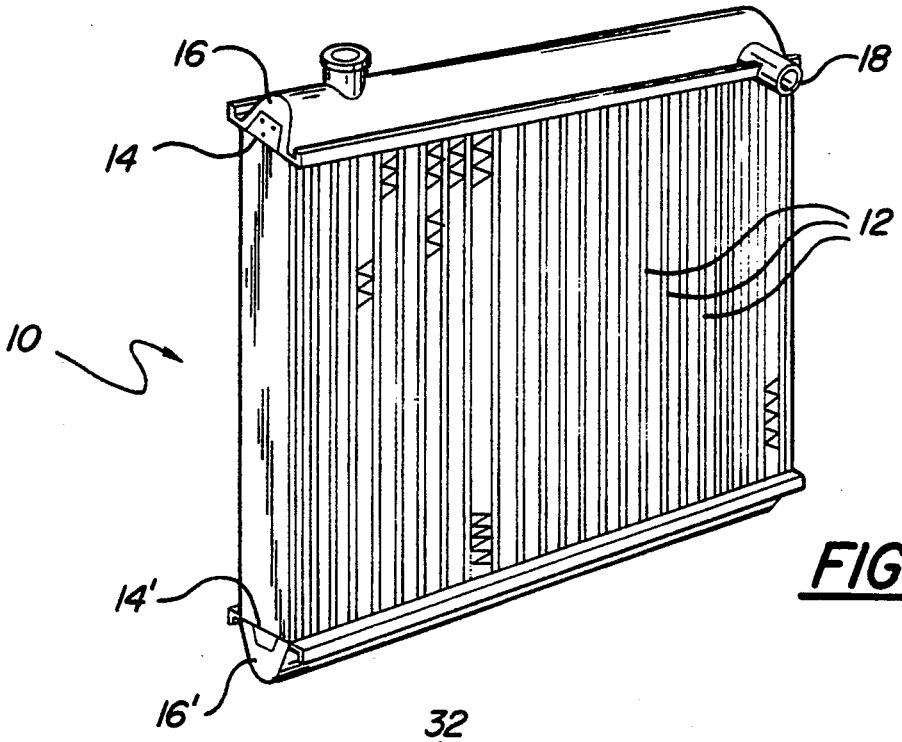
FIG. 1 is a perspective view of a heat exchanger.

Referring now to the drawings wherein like numerals indicate like or corresponding parts throughout the several views, a heat exchanger is generally shown at 10 in FIG. 1. The heat exchanger 10 includes a plurality of coolant tubes 12 extending between an upper 14 and lower 14' header. An upper 16 and lower 16' tank are secured and sealed to the upper 14 and lower 14' headers, respectively. A fluid intake 18 is located adjacent the upper tank 16 and provides a fluid access to the upper tank 16. A fluid out-take (not shown) is located adjacent the lower tank 16' and provides a fluid exit from the heat exchanger. In operation, hot fluid enters the fluid intake 18 where it travels through the upper tank 16 and down to the lower tank 16' by way of the coolant tubes 12. As the hot fluid passes through the coolant tubes 12, heat is absorbed therefrom by cooling fluid, preferably ambient air, flowing about the outside of the coolant tubes 12. Thus, heat is transferred from the hot fluid within the coolant tubes 12 to the cooling fluid passing by the outside of the coolant tubes 12. After the hot fluid has been cooled, it collects in the lower tank 16' and exits the heat exchanger 10 by way of the fluid out-take (not shown).

Figure 2:
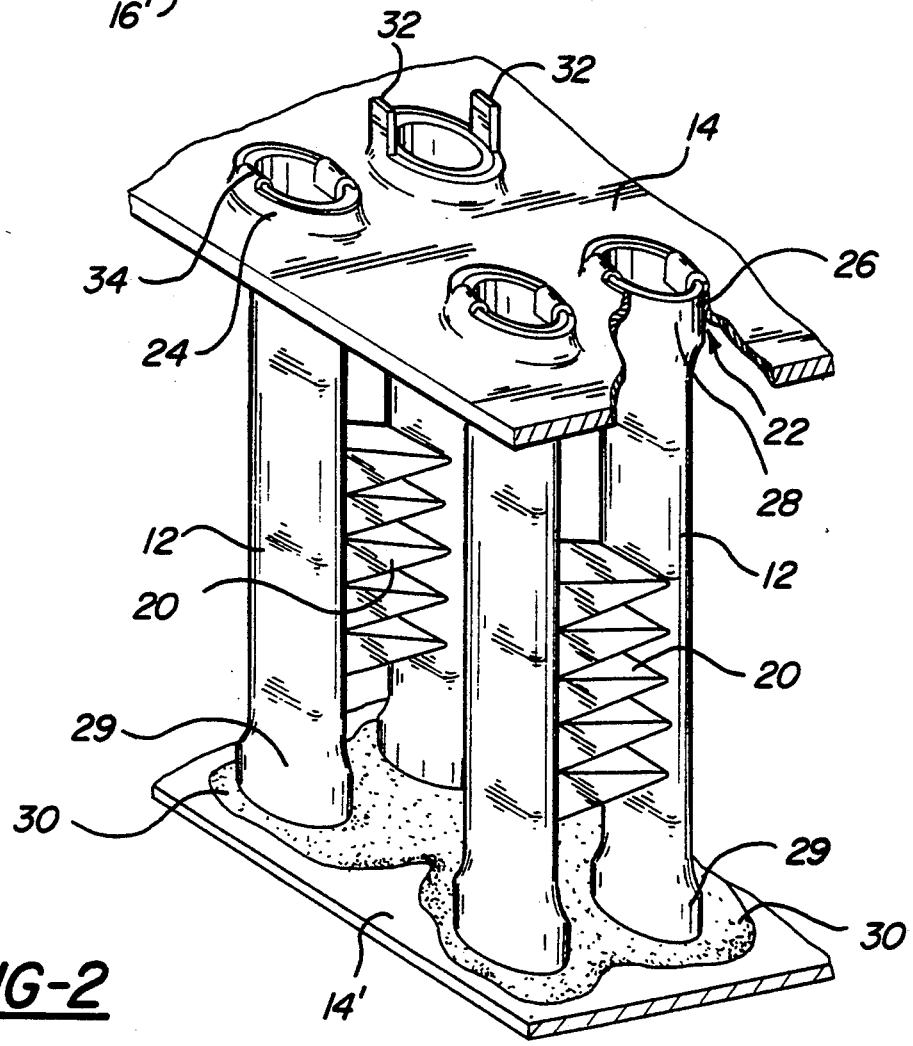
FIG. 2 is an enlarged perspective view of the heat exchanger partially cut-away showing the header, coolant tubes, and subject joint therebetween.

Turning to FIG. 2, an enlarged, partially cut-away portion of the heat exchanger 10 is provided showing a portion of both the upper 14 and lower 14' headers with coolant tubes 12 extending therebetween. Fins or vents 20 are shown positioned between the coolant tubes 12 to assist in directing cooling fluid (preferably ambient air)

about the outside of the coolant tubes 12, as is common practice in the art.

With further reference to FIG. 2, the headers 14, 14' preferably include a plurality of apertures 22 extending therethrough. Each aperture 22 includes a ferrule 24 or collar formed circumferentially thereabout. A joint 26 is formed between the coolant tube 12 and the header 14 by disposing a first end 28 of the coolant tube within the aperture 22 of the header 14 so that the end 28 of the coolant tube 12 is in relatively tight, interference fit with the periphery of the aperture 22 and ferrule 24. An identical joint may be formed between the coolant tube 12 and the lower header 14' by disposing the second end 29 of the tube 12 into an aperture extending through the lower header 14'. For the purposes of description, reference will only be made to the joint 26 formed between the upper header 14 and the first end 28 of the tube 12. Solder material 30 is provided at the interfacial contact between the end 28 of the coolant tube 12 and the header 14 (discussed in detail below) to provide a fluid tight seal therebetween. The joint 24 includes at least one tab 32 (preferably two tabs) extending from the ferrule 24 for attaching the end 28 of the coolant tube 12 to the header 14. The joint 26 further includes fastening means for fastening the end 28 of the coolant tube 12 to the tab 32. Several different embodiments of fastening means are provided within the scope of the subject invention, one of which is that shown in FIG. 2. More specifically, the fastening means shown in FIG. 2 comprises a clasp 34 formed by deforming the tab 32 over the end 28 of the coolant tube 12, best shown in FIG. 3.

Figure 3:
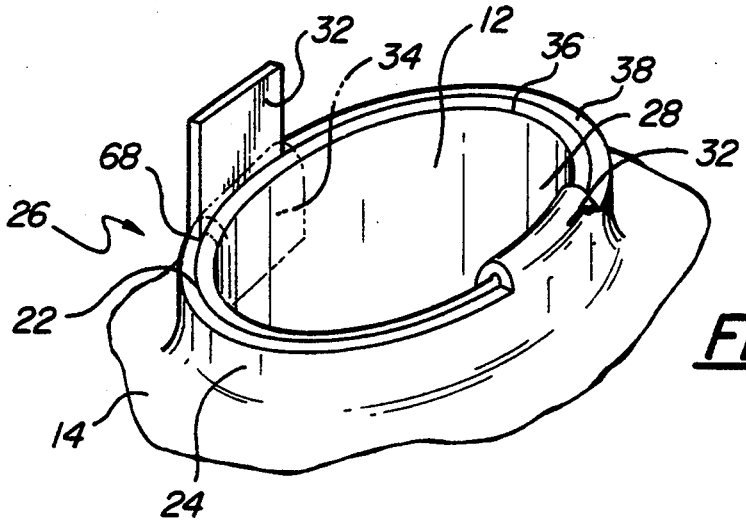
FIG. 3 is a perspective view of a preferred embodiment of the subject joint partially cut-away showing the tabs.

With reference to FIG. 3, the joint 26 formed by the end 28 of the coolant tube 12 disposed within the aperture 22 of the header 14 is generally shown at 26. In the preferred embodiment, the coolant tube 12 is inserted into the aperture 22 of the header 14 until the distal edge 36 of the end 28 of the coolant tube 12 is relatively flush with the uppermost rim 38 of the ferrule 24. The tabs 32 extending from the ferrule 24 are deformed over the distal edge 36 and end 28 of the coolant tube 12 thus forming a clasp 34 for mechanically locking the coolant tube 12 to the header 14. The mechanical lock provided by the clasp 34 adds to the strength of the joint 26 and helps prevent relative movement between the coolant tube 12 and header 14.

Figure 4:
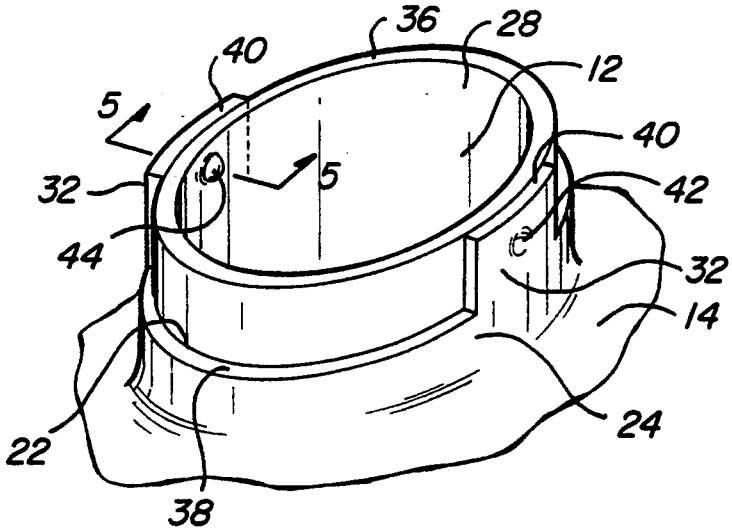
FIG. 4 is a perspective view of another preferred embodiment of the subject joint partially cut-away showing the tabs.
Figure 5:
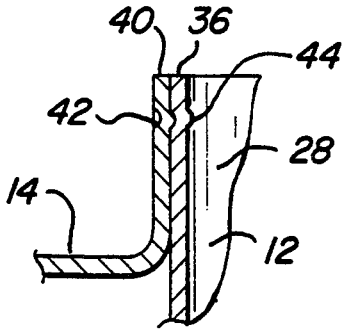
FIG. 5 is a cross-sectional view taken along lines 5—5 of FIG. 4 showing the protuberance extending from the tab and disposed within an indentation of the coolant tube.

Another embodiment of the subject joint 26 is shown in FIG. 4 wherein the coolant tube 12 is inserted into the aperture 22 of the header 14 until the distal edge 36 of the end 28 of the coolant tube 12 is relatively flush with the end 40 of the tabs 32. The fastening means for fastening the end 28 of the coolant tube 12 to the tabs 32 comprises a protuberance 42 extending from tabs 32 and a corresponding indentation 44 extending into the end 28 of the tube 12. As shown in FIG. 5, the protuberance 42 extends from the tab 32 and into the indentation 44 located in the end 28 of the tube 12. Although not shown, it will be appreciated that the protuberance 42 may extend inward from the end 28 of the tube 12 and into a corresponding indentation 44 located in the tabs 32. The protuberance 42 and indentation 44 are preferably formed simultaneously by crimping tools well known in the art.

Figure 6:
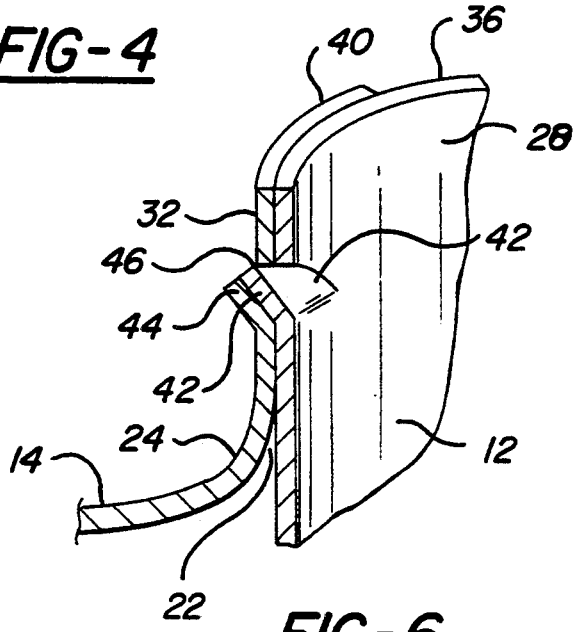
FIG. 6 is an enlarged perspective view of a portion of the tab and coolant tube partially cut-away, showing a sheared extension.

Yet another embodiment of the subject joint 26 is shown in FIG. 6. FIG. 6 is an enlarged view showing a portion of the tab 32 and end 28 of coolant tube 12 in cross-section. As with the embodiment shown in FIG. 4, the coolant tube 12 is inserted into the aperture 22 of the header 14 until the distal edge 36 of the end 28 of the coolant tube 12 is relatively flush with the end 40 of the tab 32. The fastening means for fastening the end 28 of the coolant tube 12 to the tabs 32 comprises a protuberance 42 extending from end 28 of the tube 12 and a corresponding indentation 44 extending into the tab 32. However, unlike the protuberance 42 shown in FIGS. 4 and 5, the protuberance 42 shown in FIG. 6 includes a sheared extension 46 extending in a cantilevered fashion into the indentation 44. That is, the protuberance 42 is more than a mere bulge or bump in the outer surface of the end 28 of the tube 12, but rather, the protuberance 42 includes a sheared end or extension 46 which cuts into the tab 32. Although not shown, it will be appreciated that the protuberance 42 may extend from the tab 32 into a indentation 44 located in the end 28 of the tube 12.

Figure 7:
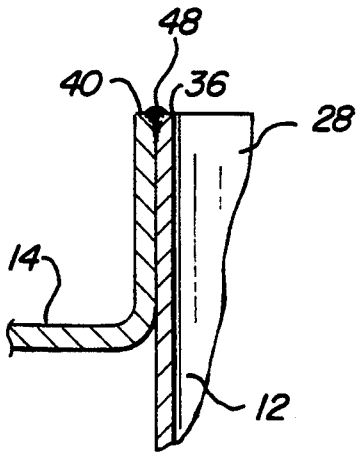
FIG. 7 is a cross-sectional view of the tab and coolant tube showing bonding agent disposed at a point therebetween.

FIG. 7 discloses yet another embodiment of the subject invention similar to the embodiments shown in FIGS. 4, 5 and 6, however, instead of providing a protuberance and indentation arrangement for mechanically locking the tube 12 to the header 14, bonding agent 48 is provided to hold the tab 32 to the end 28 of the tube 12. The bonding agent 48 preferable comprises a spot weld located between a portion of the end 28 of the coolant tube 12 and the tab 32 but may comprise a braze, solder, or organic adhesive such as epoxy. As mentioned previously, it is preferred to limit the amount of welding due to the compromising effect on the areas adjacent the actual weld due to the high temperature exposure associated with welding. Thus, a spot weld between the tab 32 and the end 28 of the coolant tube 12 is preferred.

The coolant tubes 12 are customarily flat sided as shown in FIG. 2. The flat sided shape of the tube 12 enhances heat exchange due to the large surface area of the tube 12 exposed to cooling fluid flowing by the tubes 12. Furthermore, the flat sided shape allows the coolant tubes 12 to be stacked more closely together than, for instance, circular shaped tubes. The ends 28 of the coolant tubes 12 are expanded into an elliptical shape, corresponding in shape to the aperture 22 extending through the header 14, as shown in FIG. 2. Preferably the elliptical shape of both the ends 28 of the coolant tubes 12 and the aperture is 22 oval. The oval shape of the end 28 provides a better mechanical lock with the ferrule 24 than flat sided tube ends by more even distributing outward force between the end 28 of the tube 12 and the periphery of the aperture 22. That is, flat sided tube ends tend to concentrate outward forces at the curvature of the ends whereas the oval shaped end distributes forces more evenly around the circumference of the tube ends thus avoiding tube failure.

Figure 10:
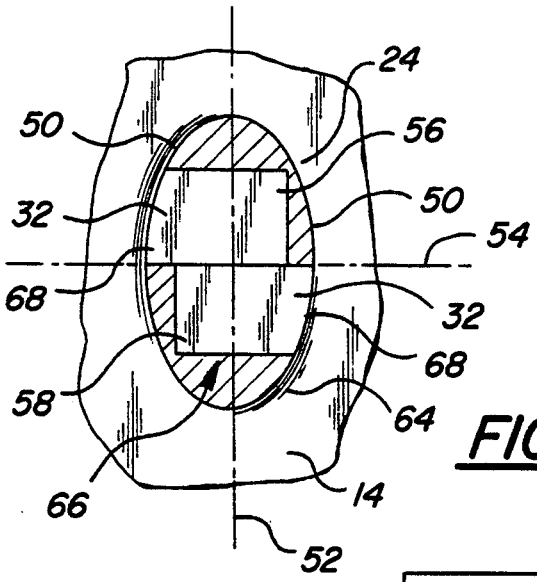
FIG. 10 is a top view of the header partially cut away showing the tabs.

FIG. 10 is a top view of a portion of the header 14 showing the ferrule periphery 50. The ferrule periphery 50 corresponds in shape and location to the periphery of the aperture 22, yet to be formed through the header 14. The section within the ferrule periphery 50 denoted by cross lines refers to portions to be removed, thus forming the aperture 22, (to be discussed in detail subsequently). Two opposing tabs 32 are shown, not yet deformed outward to form the aperture 22. Reference is made to FIG. 10 to illustrate the elliptical shape of aperture 22 to be formed. As shown, the aperture 22 (corresponding in shape to the ferrule periphery 50) is preferably oval including a major 52 and minor 54 axis. Although the subject joint 26 need include only one tab 32 for practicing the invention, the preferred embodiment contemplates two tabs 32. Ideally, a first tab 56 is secured to the ferrule 24 at a base portion 68 on one side of the major axis 52 and a second tab 58 is secured to the ferrule 24 at a base portion 68 on the opposite side of the major axis 52. Once again, although not required, the preferred embodiment of the subject invention further contemplates securing the first tab 56 to the ferrule 24 on one side of the minor axis 54 and the second tab 58 to the ferrule 24 on the opposite side of the minor axis 54. It will be understood that tabs may be located about the aperture 22 other than as specifically shown e.g., the tabs may be located at the ends of the aperture 22, positioned axially along the major axis 52.

Figure 8:
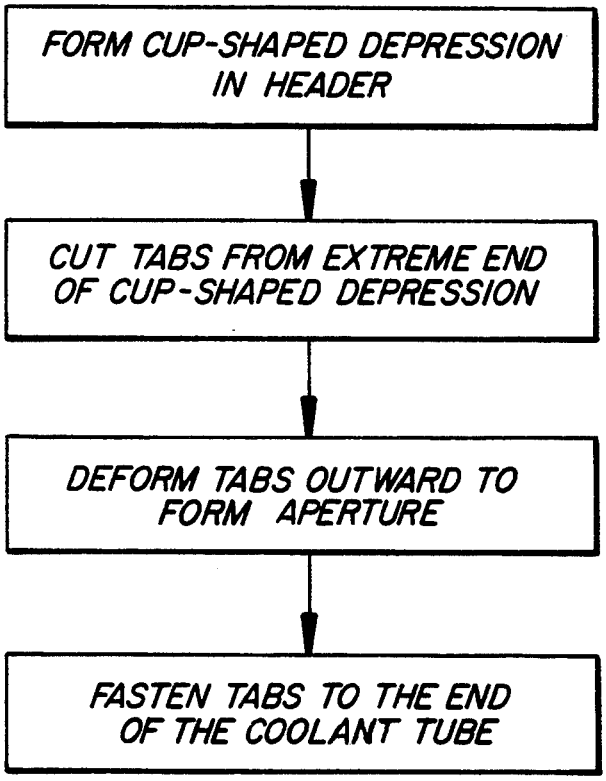
FIG. 8 is a flow chart showing the general steps of the method for making the subject joint.

The preferred method for making the subject invention will now be discussed. With reference to FIG. 8, a flow chart is provided as an overview to the subject method. Each of the individual steps will be explained in detail below.

Figure 9:
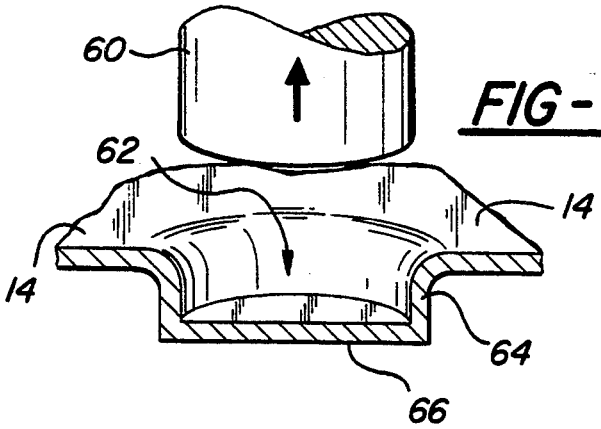
FIG. 9 is perspective view of the header partially cut away showing the cup-shaped depression being formed.

The first step of the subject method involves forming a cup-shaped depression in the header. More specifically and with reference to FIG. 9, a cylindrical die 60 is moveable into contact with the header 14 and a cup-shaped depression 62 is stamped out of the header 14. The cup-shaped depression 62 includes side walls 64 and a bottom 66. The side walls 64 define the ferrule 24. Preferably the end of the die 60 includes an elliptical shape so as to impart a corresponding elliptical, cup-shaped depression 62 into the header 14, including an elliptical shaped extreme end 66.

Once the cup-shaped depression 62 is formed, at least one tab 32 is formed in the bottom 66 of the cup-shaped depression 62. More specifically and with reference to FIG. 10, preferably two tabs 32 are cut from the extreme end 66 of the cup-shaped depression 62. As shown in FIG. 10, the first 56 and second 58 tabs are cut from the extreme end 66 of the depression 62 by essentially cutting around selected portions of the elliptically shaped ferrule periphery 50. The portions of the bottom 66 of the cup-shaped depression 62 indicated by cross lines are cut free from the depression 62 and removed, thus leaving the first 56 and second 58 tabs secured to the ferrule 24 along the base portion 68. The tabs 32 are cut into the bottom 66 of the cup-shaped depression 62 with any of the many cutting tools commonly used for such purposes in the art. For example, a die tool having sharp extending edges (not shown) may be lowered into the cup-shaped depression 62 and forced against selected areas of the bottom 66 in order to cut therethrough.

Figure 11:
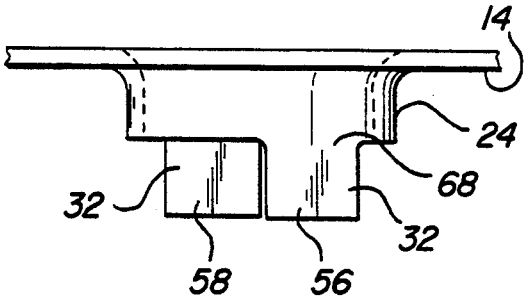
FIG. 11 is a side view of the header partially cut away showing the ferrule and tabs extending therefrom.

After the first 56 and second 58 tabs have been cut into the extreme end 66 of the cup-shaped depression 62, the tabs are deformed outward about the base portion 68, as shown in FIG. 11, so as to create an aperture 22 extending through the header 14. The tabs 32, 56, 58 may be deformed or bent outward by hand or by other well known means such as forcing a cylindrical die through the area within the ferrule periphery 50 (the aperture 22) thus bending the tabs 32, 56, 58 outward. The aperture 22 maintains an elliptical periphery 50 defining a major 52 and minor 54 axis. The joint 26 preferably includes the first 56 and second 58 tabs wherein the first tab 56 is located substantially on one side of the major 52 and minor 54 axes and the second tab 58 is located substantially on the other side of the major 52 and minor 54 axes, as shown in FIG. 10.

The end 28 of the coolant tube 12 is inserted within the aperture 22 and the tab 32 is fastened to the end 28 of the coolant tube 12 in order to secure the coolant tube 12 to the header 14. Prior to inserting the end 28 of the coolant tube 12 into the aperture 22, the end 28 is preferable expanded into an elliptical shape corresponding to the elliptical periphery of the aperture 22. The end 28 to the tube 12 may be expanded into an elliptical shape by use of a tube expander, as is common in the art (as shown in U.S. Pat. Nos. 5,099,575 to Colvin et al; 4,467,511 to Collgon; and 4,580,324 to Laska).

The subject method includes a number of different steps for fastening the end 28 of the coolant tube 12 to the tab 32. The first method for fastening the tab 32 to the end 28 of the coolant tube 12 is shown in FIGS. 2 and 3 wherein the end 28 of the coolant tube 12 is inserted into the aperture 22 of the header 14 until the distal edge 36 of the end 28 of the tube 12 is relatively flush with the uppermost rim 38 of the ferrule 24. The tabs 32 extending from the ferrule 24 are deformed over the distal edge 36 and end 28 of the coolant tube 12 thus forming a clasp 34 for mechanically locking the coolant tube 12 to the header. The tabs 32 may be deformed over the distal edge 36 and end 28 of the coolant tube 12 by bending the tabs 32 over by hand and subsequently applying additional force with pliers, clamps or the like.

Another method for fastening the tab 32 to the end 28 of the coolant tube 12 is shown in FIGS. 4 and 5 wherein the coolant tube 12 is inserted into the aperture 22 of the header 14 until the distal edge 36 of the end 28 of the tube is relatively flush with the end 40 of the tabs 32. The method includes the step of forming a protuberance 42 extending from one of the tab 32 and end 28 of the coolant tube 12 and a corresponding indentation 44 extending into the other of the end 28 of the coolant tube 12 and the tab 32, and disposing the protuberance 42 within the indentation 44 to mechanically lock the coolant tube 12 to the header 14. The protuberance 42 and indentation 44 are preferably formed simultaneously by way of a crimping tool (not shown) wherein an punch is forced against one of the tab 32 and end 28 of the coolant tube 12 thus simultaneously forming the protuberance 42 and indentation 44.

Yet another method for fastening the tab 32 to the end 28 of the coolant tube 12 is shown in FIG. 6 wherein the coolant tube 12 is inserted into the aperture 22 of the header 14 until the distal edge 36 of the end 28 of the coolant tube 12 is relatively flush with the end 40 of the tab 32. The method includes the step of forming a protuberance 42 and further includes shearing a portion of the protuberance 42 into the indentation 44. That is, the protuberance 42 is more than a mere bulge or bump in the outer surface of the end 28 of the tube 12, but rather the protuberance 42 includes a sheared end or extension 46 which cuts into the tab 32. The protuberance 42, sheared extension 46, and indentation are formed by a piercing tool commonly known in the art such as that disclosed in U.S. Pat. No. 4,334,703 to Arthur et al.

Still another method for fastening the tab 32 to the end 28 of the coolant tube 12 is shown in FIG. 7 wherein the coolant tube 12 is inserted into the aperture 22 of the header 14 until the distal edge 36 of the end 28 of the coolant tube 12 is relatively flush with the end 40 of the tab 32. The method includes the step of bonding a portion of the end 28 of the coolant tube 12 to the tab 32. More specifically, the distal edge 36 of the end 28 of the coolant tube is preferably welded to the uppermost rim 38 of the ferrule 24. Ideally, only a spot or small portion of the distal edge 36 of the end 28 of the tube 12 and uppermost rim 38 are welded. Although welding is the preferred step for bonding the tab 32 and end 28 of the tube 12, brazing or soldering may be substituted therefore.

After the tabs 32, 56, 58 have been fastened to the end 28 of the tube 12, the end 28 of the tube 12 and periphery of the aperture 22 and ferrule 24 are soldered together to provide a fluid tight seal therebetween. Solder material 30 is disposed into the interfacial contact between the end 28 of the tube 12 and the aperture 22 and ferrule 24 by any manner common in the art. For example, the header 14 having the ends 28 of the tubes 12 fastened thereto, may be dipped in a solder bath (not shown) whereby solder material is drawn into the interfacial contact area between the end 28 of the tube 12 and the periphery of the aperture 22 and ferrule 24 by way of capillary action. Another common method involves pre-coating the end 28 of the tube 12 prior to inserting the end 28 into the aperture 22 and, after the end 28 has been fastened to the tabs 32, heating the end 28 in order to melt the solder material and subsequently solder the end 28 of the tube 12 to the periphery of the aperture 22 and ferrule 24.

The invention has been described in an illustrative manner and it is to be understood that the terminology which has been used is intended to be in the nature of words of description rather than limitation. Obviously many modifications and variations of the present invention are possible in light of the above teachings. It is, therefore, to be understood that within the scope of the appended claims, the invention may be practiced otherwise than as specifically described.

What is claimed:

1. A heat exchanger (10) for exchanging heat with a cooling fluid comprising:

first and second fluid tanks (16, 16');

first and second headers (14, 14') fixedly secured to said tanks (16, 16'), respectively, and having a plurality of apertures (22) extending therethrough;

each of said apertures (22) including an outwardly extending ferrule (24) disposed circumferentially about said apertures (22);

a plurality of fluid coolant tubes (12) having first (28) and second (29) ends connected between said first and second tanks (16, 16') for communicating fluid therebetween;

a plurality of joints (26) formed by said ends (28, 29) of said coolant tubes (12) disposed within said apertures (22) of said headers (14, 14');

each of said joints (26) including sealant means (30) for sealing flow of fluid through said joints (26) between said headers (14, 14') and said coolant tubes (12); and each of said joints (26) including at least one tab (32) extending from said ferrule (24) and deformed over said end (28, 29) of said coolant tube (12) to mechanically lock said coolant tube (12) to said header ( 14, 14').

2. The heat exchanger as set forth in claim 1 further characterized by said apertures (22) having an elliptical periphery defining a major axis (32) and minor axis (34).

3. The heat exchanger (10) as set forth in claim 2 further characterized by said end (28, 29) of said coolant tubes (12) having an elliptical outer periphery corresponding to said elliptical periphery of said aperture (22).

4. The heat exchanger (10) as set forth in claim 2 wherein each of said joints said (26) includes a first (56) and second (58) tab and is further characterized by said first tab (56) secured to said ferrule (24) on one side of said major axis (56) and said second tab (58) secured to said ferrule (24) on the opposite side of said major axis (56).

5. The heat exchanger (10) as set forth in claim 4 further characterized by said first tab (56) secured to said ferrule (24) substantially on one side of said minor axis (54) and said second tab (58) secured to said ferrule (24) on substantially the opposite side of said minor axis (54).

6. The heat exchanger (10) as set forth in claim 1 further characterized by said joint (26) including solder material (30) disposed between said end (28) of said coolant tube (12) and said header (14).

7. A heat exchanger (10) for exchanging heat with a cooling fluid comprising:

first and second fluid tanks (16, 16');

first and second headers (14, 14') fixedly secured to said tanks (16, 16'), respectively, and having a plurality of apertures (22) extending therethrough;

each of said apertures (22) having an elliptical periphery and including an outwardly extending elliptical ferrule (24) disposed circumferentially about said aperture (22);

a plurality of fluid coolant tubes (12) having first (28) and second (29) ends connected between said first and second tanks (16, 16') for communicating fluid therebetween;

each of said ends (28, 29) of said coolant tubes (12) having an elliptical outer periphery corresponding to said elliptical periphery of said apertures (22);

a plurality of joints (26) formed by each of said ends (28, 29) of said coolant tubes (12) disposed within said apertures (22) of said headers (14, 14');

each of said joints (26) including first (56) and second (58) tabs extending from said ferrule (24) and offset along opposite sides of said elliptical periphery of said aperture (22); and each of said tabs (56, 58) deformed over said end (28, 29) of said coolant tube (12) to mechanically lock said coolant tube (12) to said header (14, 14').

8. The heat exchanger (10) as set forth in claim 7 further characterized by each of said elliptical apertures (22) defining a major axis (32) and a minor axis (34).

9. The heat exchanger (10) as set forth in claim 8 further characterized by said first tab (56) secured to said ferule (24) on one side of said major axis (56) and said second tab (58) secured to said ferrule (24) on the opposite side of said major axis (56).

10. The heat exchanger (10) is set forth in claim 9 further characterized by said first tab (56) secured to said ferrule (24) substantially on one side of said minor axis (54) and said second tab (58) secured to said ferrule (24) on substantially the opposite side of said minor axis (54).

11. The heat exchanger (10) as set forth in claim 7 further characterized by said joint (26) including solder material (30) disposed between said end (28) of said coolant tube (12) and said header (14) to provide a fluid impervious seal therebetween.

* * * * *